US006014885A

United States Patent [19]

Griffaton

[11] Patent Number: 6,014,885

[45] Date of Patent: Jan. 18, 2000

[54] DENT REMOVAL APPARATUS AND METHOD OF OPERATION

[76] Inventor: Gerald J Griffaton, 1308 Argyle Rd., Berwyn, Pa. 19312

[21] Appl. No.: 08/958,424

[22] Filed: Oct. 27, 1997

[51] Int. Cl.[7] ..... B21D 1/06

[52] U.S. Cl. ..... 72/453.16; 72/705

[58] Field of Search ..... 72/409.01, 447, 72/457, 705, 453.15, 453.16; 81/301, DIG. 12

[56] References Cited

U.S. PATENT DOCUMENTS

| | | | |
|---|---|---|---|
| 2,054,248 | 9/1936 | Eronen | 72/447 |
| 2,435,726 | 2/1948 | Rohde | 72/705 |
| 2,768,544 | 10/1956 | Back | 72/705 |
| 3,922,902 | 12/1975 | Jarman | 72/453 |
| 4,754,637 | 7/1988 | O'Dell | 72/430 |
| 4,782,687 | 11/1988 | Papesh | 72/705 |
| 5,119,667 | 6/1992 | Hollis et al. | 72/705 |
| 5,329,802 | 7/1994 | Nunez | 72/457 |
| 5,408,861 | 4/1995 | McCain | 72/457 |
| 5,479,804 | 1/1996 | Cook | 72/35 |

*Primary Examiner*—Lowell A. Larson
*Attorney, Agent, or Firm*—LaMorte & Associates P.C.

[57] ABSTRACT

A tool apparatus and method of use for repairing dents in sheet metal. The tool contains two elongated arms that extend out of a common housing. The two arms terminate generally in the same plane a predetermined distance from the housing. One of the elongated arms terminates with an interchangeable anvil head. The other elongated arm terminates with an impact head. The impact head is placed below a dent in a sheet metal structure. The anvil head is supported in the exterior of the sheet metal structure over the dent. A motor is disposed within the common housing. The motor moves at least one of the elongated arms and causes the impact head and the anvil head to strike one another. When a dent in sheet metal is placed in between the impact head and the anvil head, the dent is deformed and is forced into the shape of the anvil head, thereby repairing the dent.

11 Claims, 5 Drawing Sheets

DENT REMOVAL APPARATUS AND METHOD OF OPERATION

BACKGROUND OF THE INVENTION

1. Field of the Invention

The present invention relates to tools and other mechanisms that are used to remove dents from the surfaces of automobiles and other objects made of sheet metal. More particularly, the present invention relates to dent removal tools that are powered by pneumatic, hydraulic or electric motors.

2. Description of the Prior Art

Dent removal tools are commonplace in most automobile repair shops. Such tools are used to repair small dents in the exterior sheet metal of an automobile. Such dents commonly occur in automobiles for a variety of reasons. Those reasons include falling tree branches, hail stones, and impacts with adjacent car doors in a parking lot.

In the prior art, there are a variety of tools and techniques that are used to remove dents from sheet metal. If a sheet metal panel is accessible both above and below a dent, the most common technique for repairing the dent is through the use of a hammer and anvil. In this technique, a shaped anvil is placed above the dent. A hammer then strikes the metal from below the dent, thereby forcing the metal to conform to the shape of the above lying anvil. The hammer can be manually operated. However, to quicken the procedure, power operated hammers have been developed, such as is exemplified by U.S. Pat. No. 5,119,667 to Hollis, entitled Pneumatic Hammer Apparatus.

One of the advantages of the hammer and anvil dent removal technique is that the sheet metal is never pierced. Furthermore, the use of a hammer and anvil makes the dent in the sheet metal conform nearly perfectly to its original shape. Consequently, filler putty or solder need not be used to either smooth the dent or close a hole in the sheet metal.

In many applications, the area of sheet metal below a dent is not readily accessible. Accordingly, no conventional hammer or anvil can be placed below the dent. In such scenarios, dent pullers are commonly used. Dent pullers come in two major types. The first type is a contains a screw at its forward most tip and a sliding weight. To repair a dent, a hole is first drilled into the dent. The screw at the tip of the puller is then screwed into the hole. The slide weight is then moved reciprocally until the dent is pulled out of the sheet metal. Such screw tipped pullers are exemplified by U.S. Pat. No. 5,408,861 to McCain, entitled Dent Removing Pneumatic Puller and U.S. Pat. No. 3,922,902 to Jarman, entitled Dent Removal Device.

The second common type of dent pulling device does not have a screw tip. Rather, such devices have a welding tip that welds to the sheet metal in the area of the dent. Once the tip is welded to the sheet metal, the tip is pulled using a sliding weight. Such prior art devices are exemplified by U.S. Pat. No. 3,801,772 to Curcio, entitled In-Ding Repair Tool.

A problem associated with both major types of dent pullers is that the puller only attaches to one point of the dent at a time. As a result, the dent puller does not evenly deform the sheet metal. The result is that the dent must be pulled out to an inexact shape, The dent is then corrected by using a filler, such as fiberglass or solder. The dent is then sanded into its finished configuration.

The repairing of dents using fillers and sanding is not preferred because such repair techniques are labor intensive. Furthermore, any filler used to repair the dent may separate from the sheet metal in the future if the automobile exterior is ever again damaged by a collision or by weathering.

A need therefore exists in the art for a dent repair device that is capable of repairing a dent without the use of pullers and/or body filler, even when the underside of the dent is inaccessible. Such a need is met by the present invention as described and claimed below.

SUMMARY OF THE INVENTION

The present invention is a tool apparatus and method of use for repairing dents in sheet metal. The tool contains two elongated arms that extend out of a common housing. The two arms terminate generally in the same plane a predetermined distance from the housing. One of the elongated arms terminates with an interchangeable anvil head. The other elongated arm terminates with an impact head. The impact head is placed below a dent in a sheet metal structure. The anvil head is supported in the exterior of the sheet metal structure over the dent. A motor is disposed within the common housing, The motor moves at least one of the elongated arms and causes the impact head and the anvil head to strike one another. When a dent in sheet metal is placed in between the impact head and the anvil head, the dent is deformed and is forced into the shape of the anvil head, thereby repairing the dent.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The present invention is a power tool used to remove dents from sheet metal. Although the present invention tool can be powered by an electric motor or a hydraulic motor, the present invention assembly is particularly well suited for use with a pneumatic drive. Accordingly, the exemplary embodiment of the present invention will be described in a configuration that contains a pneumatic drive.

Figure 1:
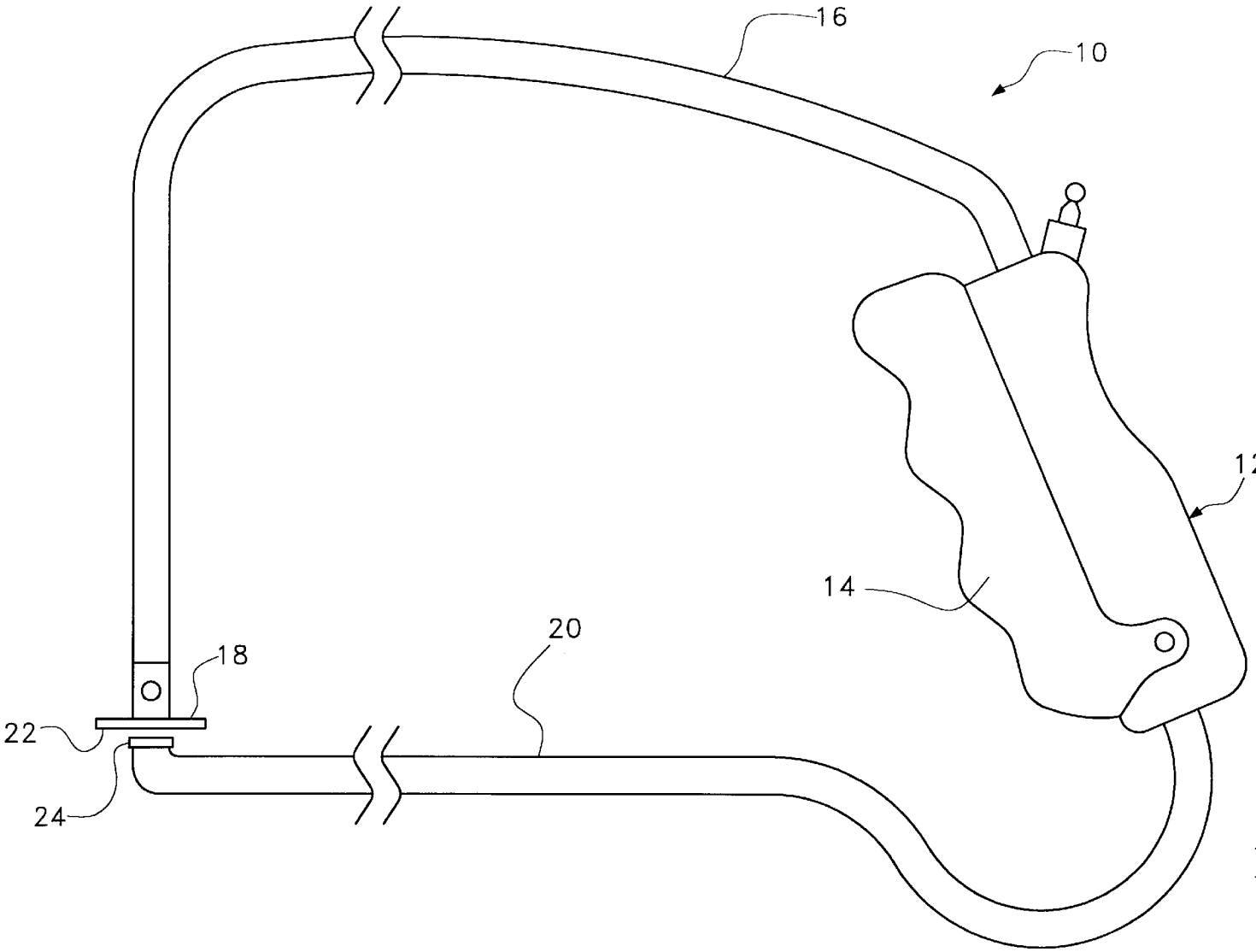
FIG. 1 is a side view of one preferred embodiment of the present invention assembly.

Referring to FIG. 1, there is shown one preferred embodiment of the present invention tool assembly 10. The tool assembly 10 includes a housing 12. A pneumatic motor is retained within the housing 12, as will be later explained. An activator handle 14 is coupled to the exterior of the housing 12. When the activator handle 14 is depressed, the pneumatic motor within the housing 12 is activated.

Two elongated arms extend from the housing 12. The upper arm is an anvil arm 16. In the shown embodiment, one end of the anvil arm 16 is rigidly affixed to the housing 12. The opposite end of the anvil arm is connected to a removable anvil head 18. The anvil head 18 has a contact surface 22 that faces downwardly toward the second arm. In the shown embodiment, the anvil contact surface 22 is flat. However, by changing the removable anvil head 18, anvil contact surfaces that are convex, concave, bulbous or pointed can be obtained.

The elongated arm that extends from the bottom of the housing 12 is a hammer arm 20. As will be later explained, the hammer arm 20 vibrates and strikes the anvil head 18 that is supported by the anvil arm 16. A replaceable impact head 24 is disposed at the end of the hammer arm 20. The impact head 24 can have many different shapes including a planar shape, a convex shape, a concave shape, a bulbous shape or a pointed shape. Regardless of its shape, the impact head 24 is preferably hardened so it does deform when stuck against a dent in sheet metal. The hammer arm 20 and impact head 24 are narrow, whereby both can be passed through a hole having a diameter between ¼ inch and ¾ inch for a purpose which will later be explained.

The hammer arm 20 supports the impact head 24 directly below the contact surface 22 of the anvil head 18. As a result, when the tool assembly 10 is activated, the impact head 24 is caused to strike against the anvil head 18 in rapid succession. If a piece of sheet metal were placed in between the impact head 24 and the anvil head 18, the repeated blows from the impact head 24 would cause the sheet metal to deform to the shape of the anvil head 18. Consequently, by placing a sheet metal dent in between an impact head 24 and an anvil head 18 of the appropriate contours, the dent can be worked out of the metal.

In automotive body repair, one of the common places that dents occur is in the doors of the automobile. The dents are caused when the door is opened against a standing object or when the door of an adjacent automobile strikes the door in a parking lot. A common problem with repairing dents in automobile doors is that the back side or the dent is inaccessible. As a result, the door must be completely disassembled or a dent puller must be used. The present invention tool offers a third option that has not before existed.

Figure 2:
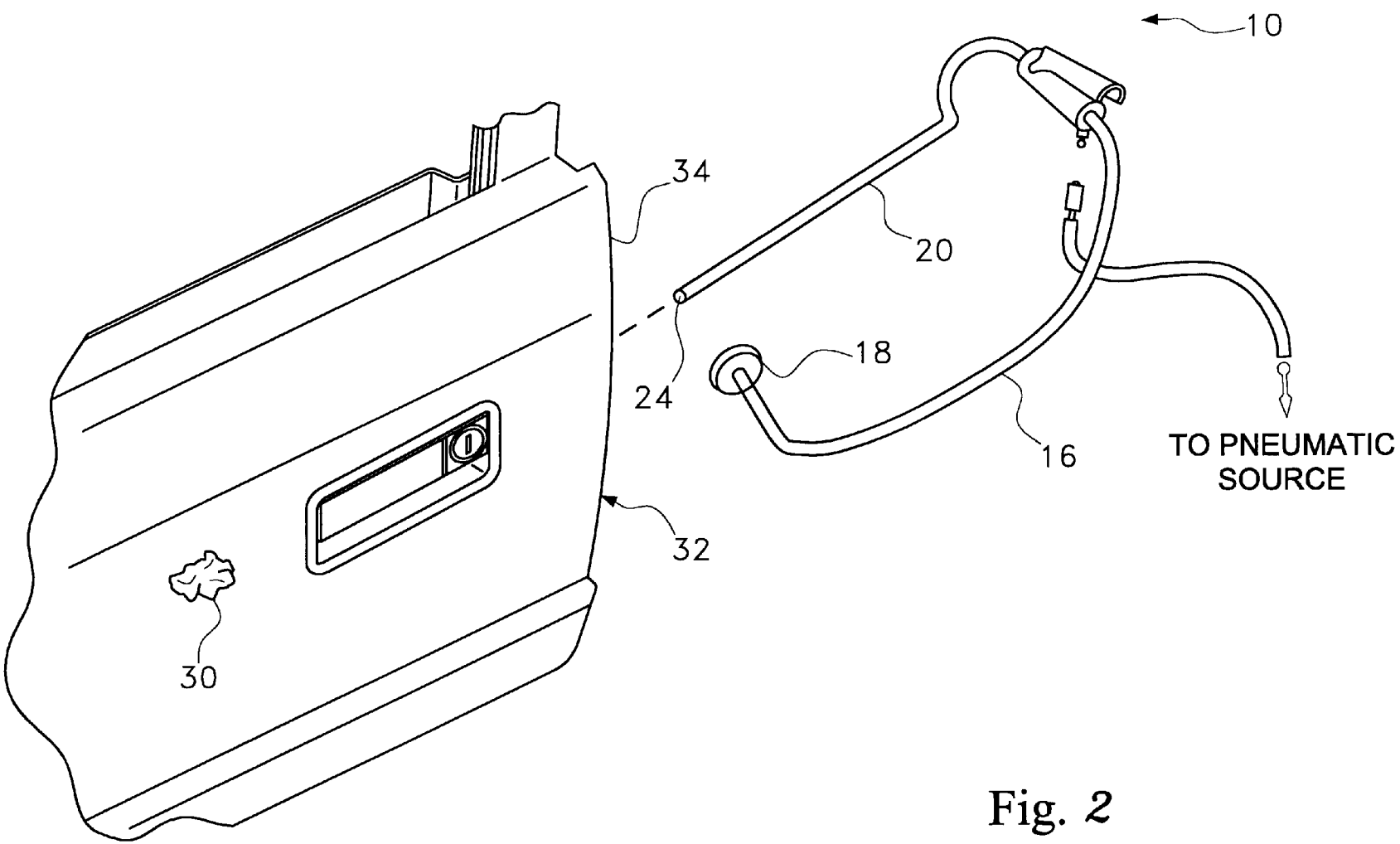
FIG. 2 is a perspective view of the embodiment of the present invention shown in FIG. 1, shown in conjunction with a car door panel to illustrate a preferred method of use.

Referring to FIG. 2, it can be seen that when a dent 30 is present in the middle of an automobile door 32, the present invention tool assembly 10 can be used. To use the present invention tool assembly 10, a hole is first drilled into the side panel 34 of the door 32. The hammer arm 20 is then inserted through the hole until the impact head 24 is supported behind the dent 30. The impact head 24 is narrow. As such, the hammer arm 20 and impact head 24 can be readily passed through the drilled hole.

An anvil head 18 is placed on the anvil arm 16 that closely matches the contour of the sheet metal surrounding the dent 30. When the tool is activated, the hammer arm 20 begins to vibrate and the impact head 24 strikes the dent 30 from inside the door panel. The dent 30 is braced by the anvil head 18 on the anvil arm 16. The impacts from the impact head 24 deforms the sheet metal and causes the sheet metal to conform to the shape of the anvil head 18. Since the anvil head 18 is selected to match the contour of the door, the dent 30 is deformed back into the desired contour of the door. The dent in the sheet metal can therefore be prepared without piercing the sheet metal and without using body fillers.

Once the dent 30 is worked back into the contour of the door 32, the hammer arm 20 is retracted from the hole in the side door panel 34. The hole is then blocked using an elastomeric stopper or some other obstruction. The door 32 is now ready to be painted in the area of the dent 30 and the repair is complete.

Figure 3:
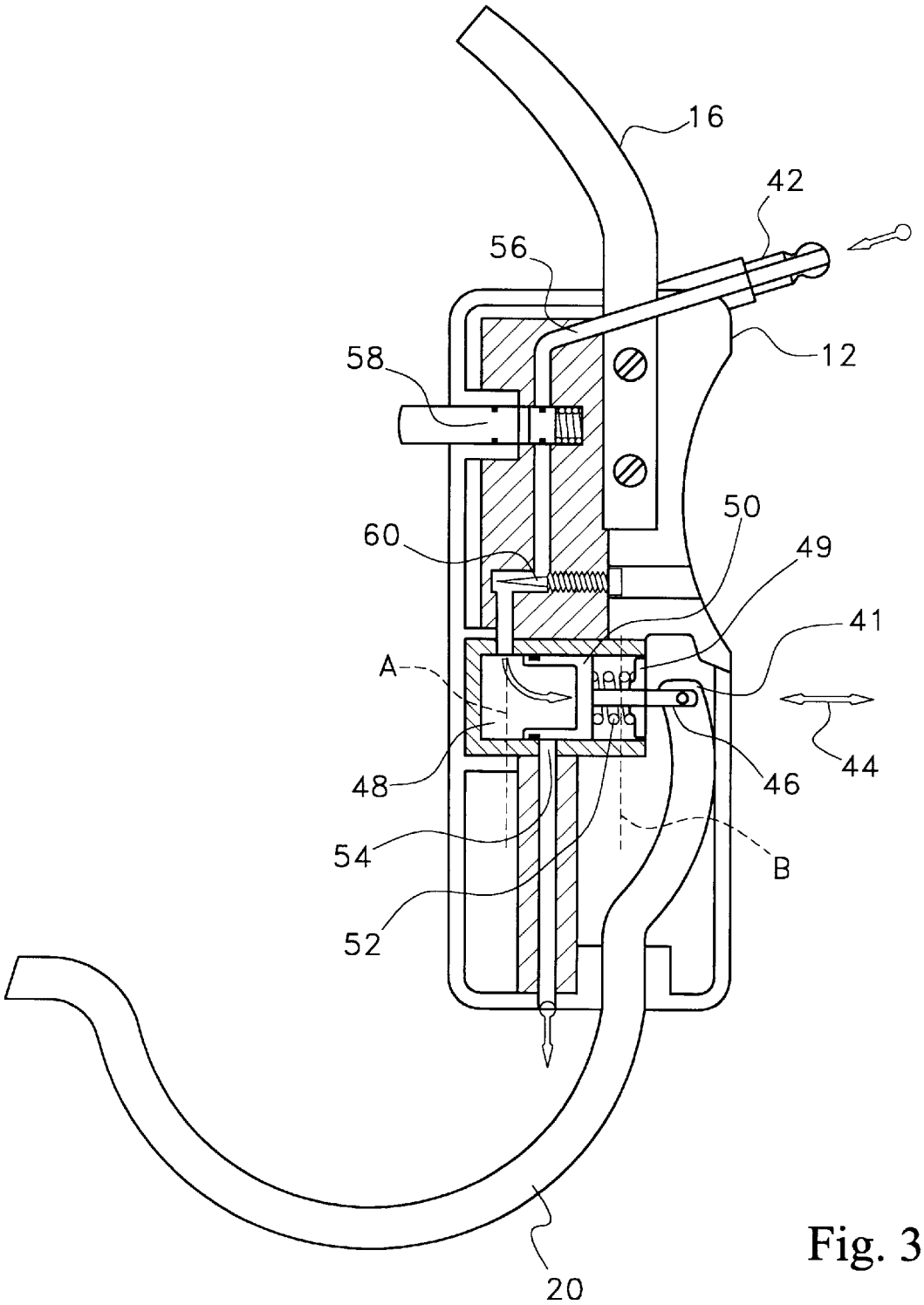
FIG. 3 is cross-sectional view of the embodiment of the present invention shown in FIG. 1, viewed along section line 3—3.

Referring to FIG. 3, it can be seen that the anvil arm 16 is rigidly mounted to the housing 12. The hammer arm 20, however, is coupled to a motor that moves the hammer arm 20 relative the housing 12. A dent in an automobile can be at almost any location. The present invention tool preferably comes with a variety of different sets of anvil arms 16 and hammer arms 20. The anvil arms 16 and hammer arms 20 can come in many different lengths and configurations to reach different dents in different locations. As such, it will be understood that the configuration of the anvil arm 16 and hammer arm 20 shown in the drawings is merely an example of one possible embodiment. The hammer arm 20 and the anvil arm 16 must be matched in order to support the impact head and the anvil head on opposite sides of the same dent. According, different hammer arms 20 and anvil arms 16 are preferably color coded or otherwise coded so that only a proper combination of a hammer arm 20 and an anvil arm 16 will be used.

In the shown embodiment, the motor used to drive the hammer arm 20 is a pneumatic motor that is selectively coupled to a pressurized air source via a pneumatic coupling 42. The distal end 41 of the hammer arm 20 connects to the drive motor. The hammer arm 20 is also pivotable coupled to the housing 12 a short distance below its distal end 41. Consequently, it will be understood that as the drive motor moves the distal end 41 of the hammer arm 20 back and forth in the directions of arrow 44, that movement is translated into an up and down movement at the impact head on the opposite end of the hammer arm 20. The up and down movement of the impact head causes the impact head to repeatedly strike the anvil head or and object placed between the impact head and the anvil head.

The distal end 41 of the hammer arm 20 is pivotably connected to a piston shaft 46. The piston shaft 46 extends into a piston chamber 48 through a forward wall 49 and engages a pneumatic piston 50 within the chamber 48. The piston 50 is biased away from the forward wall 49 by a return spring 52. The range of movement for the piston 50 in the piston chamber 48 corresponds to the compression length of the spring 52. When the return spring 52 is unbiased, the piston 50 is aligned with imaginary line A. When the return spring 52 is fully compressed, the piston 50 aligns with imaginary line B. A vent port 54 is disposed in the bottom of the piston chamber 48 at some point in between imaginary line A and imaginary line B.

Compressed air enters the housing through a pneumatic coupling 42. The compressed air flows through a supply conduit 56 that extends from the pneumatic coupling 42 to the piston chamber 48. An on/off valve 58 is disposed along the supply conduit 56. The on/off valve 58 is coupled to the activation handle 14 (FIG. 1), whereby the on/off valve 58 is open only when the activation handle is squeezed. Air flow is also controlled by a regulator valve 60 that selectively regulates the maximum volume of air permitted to flow into the piston chamber 48.

When the on/off valve 58 is open, compressed air flows past the regulator valve 60 and into the piston chamber 48. As the air pressure rises in the piston chamber 48, the piston 50 moves from imaginary line A back toward imaginary line B. As soon as the piston 50 moves past the vent aperture 54, the compressed air vents out of the piston chamber 48 and the return spring 52 returns the piston 50 to imaginary line A. This cycle automatically repeats many times per second depending upon the air pressure, the air flow and the strength of the return spring.

The use of the pneumatic drive motor described is only exemplary and it should be understood that any pneumatic, hydraulic or electric motor could be adapted for use in the present invention.

Figure 4:
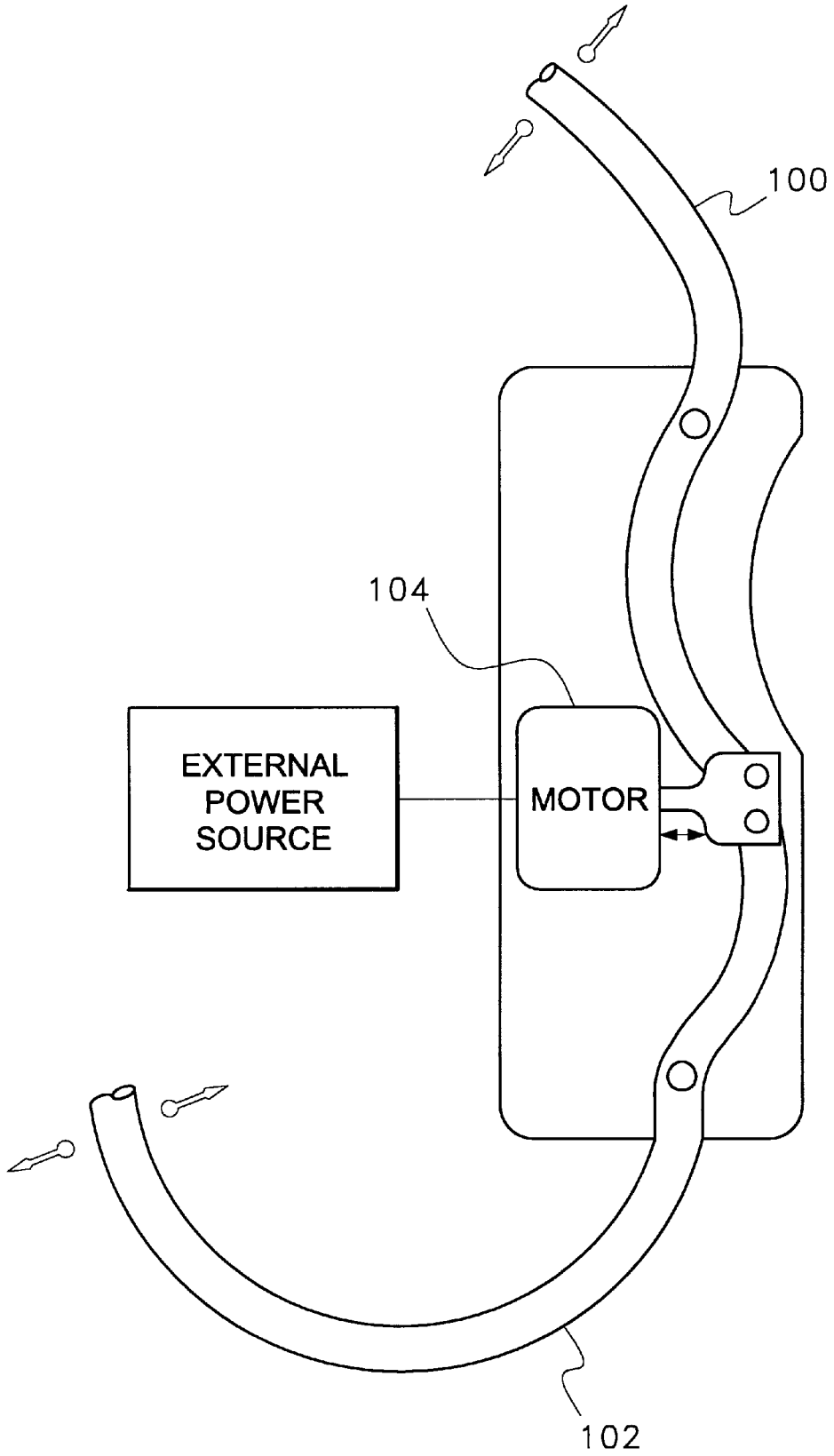
FIG. 4 is a schematic view of an alternate embodiment of the present invention dent removal tool.

Referring to FIG. 4, an alternate embodiment of the present invention is shown. In this embodiment, there is no anvil arm. Rather, this embodiment uses two hammer arms 100, 102 that strike against one another on either side of a dent. In this embodiment, both the hammer arms 100, 102 are coupled to a common drive motor 104. As a result, the movement of the hammer arms 100, 102 is coordinated. The anvil heads formally used on the stationary anvil arm of FIG. 1 can be connected to the ends of either of the hammer arms 100, 102 as needed.

Figure 5:
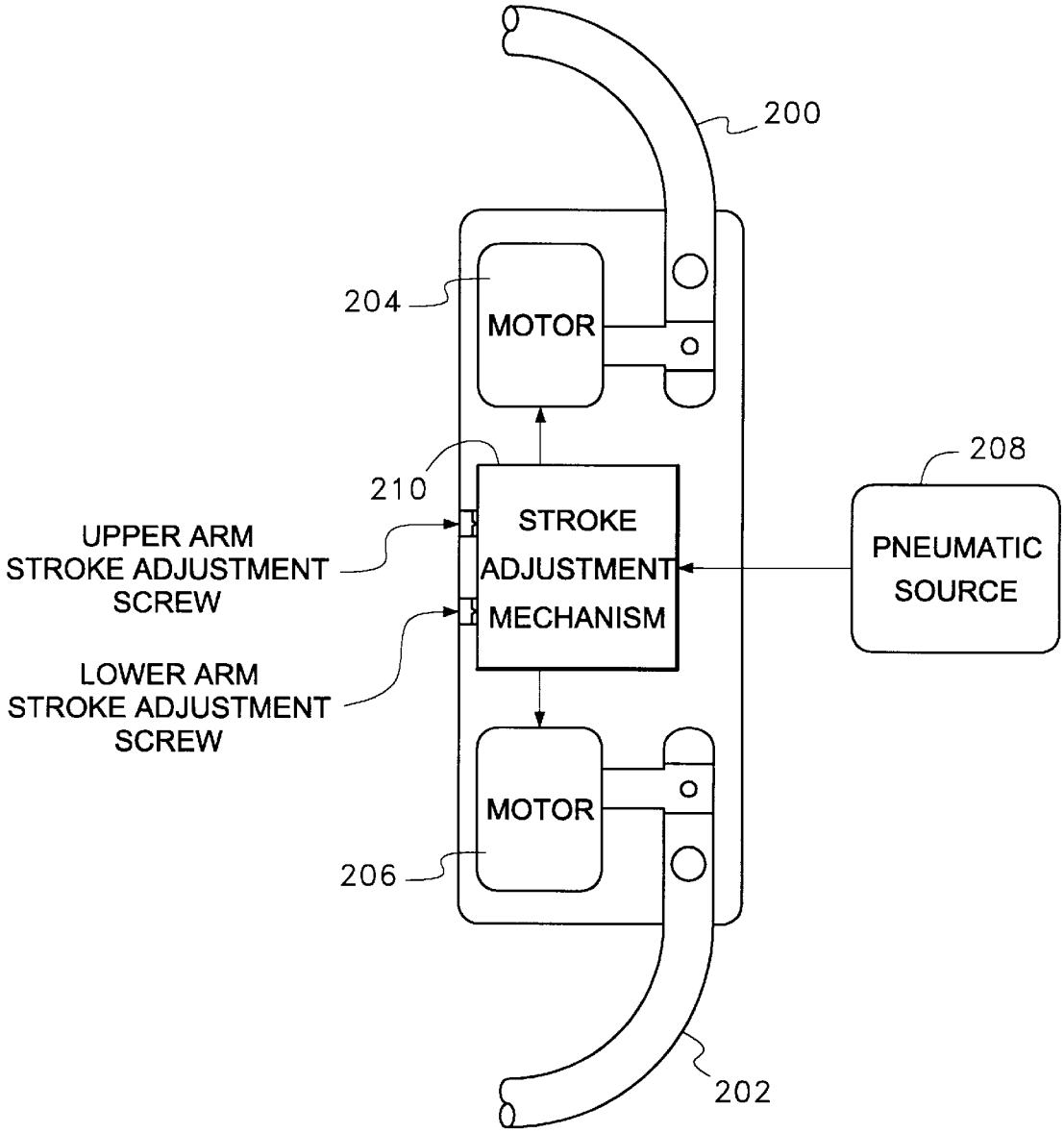
FIG. 5 is a schematic view of a second alternate embodiment of the present invention dent removal tool.

Referring to FIG. 5, a second alternate embodiment of the present invention is shown. In this embodiment, there is also no anvil arm. Like the embodiment of FIG. 4, this embodiment uses two hammer arms 200, 202 that strike against one another on either side of a dent. In this embodiment, both the hammer arms 200, 202 are coupled to separate drive motors 204, 206. Both drive motors 204, 206 are powered by a common power source, such as a pneumatic source 208. Also in this embodiment, a stroke adjustment mechanism 210 is provided. The stroke adjustment mechanism 210 is coupled to both of the drive motors 204, 206. The stroke adjustment mechanism 210 controls the range of movement for the two drive motors 204, 206. As a result, the two drive motors 204, 206 can be adjusted from a large stroke condition to a small stroke condition. The stroke adjustment mechanism 210 may adjust the two drive motors 204, 206 simultaneously. However, in the shown embodiment separate adjustments are provided for the upper drive motor 204 and the lower drive motor 206. This allows the stroke of both the upper hammer arm 200 and the lower hammer arm 202 to be independently adjusted.

The stroke adjustment mechanism would be different depending upon the power source of the drive motors. Mechanisms for limiting the stroke of pneumatic pistons, hydraulic pistons and electric pistons are all known in the art, Any such stroke adjustment mechanism can be adapted for use with the present invention.

It will be understood that the various figures described above illustrate only preferred embodiments of the present invention. Features from the different embodiments can be mixed to produce yet further embodiments. A person skilled in the art can therefore make numerous alterations and modifications to the shown embodiments utilizing functionally equivalent components to those shown and described. All such modifications are intended to be included within the scope of the present invention as defined by the appended claims.

What is claimed is:

1. A tool assembly for repairing dents in sheet metal, comprising:

a handle housing having a pneumatic input port disposed thereon;

a first elongated arm having a first end and a second end; wherein said second end of said first elongated arm extends into said handle housing and said first elongated arm is pivotably connected to said handle housing at a pivot point within said handle housing proximate said second end;

a second elongated arm having a first end and a second end, wherein said second end of said second elongated arm is connected to said handle housing;

a pneumatic motor disposed within said handle housing, said pneumatic motor being coupled to said second end of said first elongated arm, wherein said pneumatic motor reciprocally moves said second end of said first elongated arm and causes said first elongated arm to repeatedly move about said pivot point, thereby causing said first end of said first elongated arm to repeatedly move toward and away from said first end of said second elongated arm; and an on/off valve disposed within said handle housing between said pneumatic motor and said pneumatic input port.

2. The assembly according to claim 1, further including an anvil head selectively attachable to said first end of said second elongated arm.

3. The assembly according to claim 2, wherein said anvil head has in impact surface having a shape selected from a group consisting of a planar surface, a concave surface, a convex surface, a bulbous surface and a pointed surface.

4. The assembly according to claim 1, wherein said first end of said first elongated arm and said first end of said second elongated arm extend approximately the same distance away from said handle housing.

5. The assembly according to claim 1 wherein first elongated arm is narrowly shaped and is capable of passing through a hole with a diameter of ¾ inch or less.

6. The assembly according to claim 1, further including an impact head selectively attachable to said first end of said first elongated arm.

7. The assembly according to claim 6, wherein said impact head has a surface shape selected from a group consisting of a planar surface, a concave surface, a convex surface, a bulbous surface and a pointed surface.

8. The assembly according to claim 7, wherein said impact head is fabricated from hardened steel.

9. A dent removal tool, comprising:

a housing;

a hammer element extending from said housing, wherein said hammer element is pivotably connected to said housing at a first pivot point;

an anvil element extending from said housing, wherein said anvil element is pivotably connected to said housing at a second pivot point;

a pneumatic motor disposed within said housing, said pneumatic motor being coupled to both said hammer element and said anvil element, wherein said pneumatic motor reciprocally moves said hammer element about said first pivot point and reciprocally moves said anvil element about said second pivot point for causing said hammer element and said anvil element to strike each other at a predetermined distance from said housing.

10. The tool according to claim 9, further including an anvil head selectively attachable to said anvil element.

11. The tool according to claim 10, wherein said anvil head has an impact surface having a shape selected from a group consisting of a planar surface, a concave surface, a convex surface, a bulbous surface and a pointed surface.

* * * * *